US009849960B1

(12) United States Patent
Garofalo et al.

(10) Patent No.: US 9,849,960 B1
(45) Date of Patent: Dec. 26, 2017

(54) TILLER CONTROL DEVICE

(71) Applicants: Sam Garofalo, Mooresville, NC (US); James C. Sisco, Jr., Mooresville, NC (US)

(72) Inventors: Sam Garofalo, Mooresville, NC (US); James C. Sisco, Jr., Mooresville, NC (US)

(73) Assignee: Technical Consulting Associates LLC, Mooresville, NC (US)

( * ) Notice: Subject to any disclaimer, the term of this patent is extended or adjusted under 35 U.S.C. 154(b) by 0 days.

(21) Appl. No.: 15/195,992

(22) Filed: Jun. 28, 2016

(51) Int. Cl.
*B63H 25/04* (2006.01)
*B63H 25/10* (2006.01)
*B63H 25/38* (2006.01)

(52) U.S. Cl.
CPC ..... *B63H 25/38* (2013.01); *B63H 2025/384* (2013.01)

(58) Field of Classification Search
CPC ..... B63H 25/25; B63H 25/38; B63H 25/52; B63H 2025/024; B63H 2025/38; B63H 2025/384; B63H 2025/385
USPC ..... 114/144 R, 162
See application file for complete search history.

(56) References Cited

U.S. PATENT DOCUMENTS 1,401,290 A * 12/1921 Taylor ..... B63H 25/34 114/170
2,237,834 A * 4/1941 Landgraf, Jr. ..... B63H 21/265 114/144 R
2,846,896 A * 8/1958 Allen ..... B63H 21/265 114/172
3,279,410 A 10/1966 Young
3,797,441 A 3/1974 Burnett
4,080,918 A 3/1978 Bonhard
4,178,869 A 12/1979 Turrentine
4,241,684 A 12/1980 Davis
4,476,800 A 10/1984 Gage
4,480,572 A * 11/1984 Lauterbach ..... B63H 25/52 114/162
4,907,521 A * 3/1990 Kresse ..... B63H 25/52 114/162
8,069,803 B1 * 12/2011 Crawford ..... B63H 25/10 114/144 R
D721,321 S * 1/2015 Miedema, II ..... D12/317

* cited by examiner

*Primary Examiner* — Daniel V Venne
(74) *Attorney, Agent, or Firm* — Ronald L. Hofer

(57) ABSTRACT

A kit is provided which can be installed on a sailboat and used to selectively control the position of the tiller of the sailboat to allow the helmsman to leave the tiller unattended for a limited period of time. The kit is to be mounted on the transom of the sailboat and comprises:

a mounting receiver adapted to be attached to the transom;

an arm having a rearward end adapted to be attached to said mounting receiver and to extend forwardly therefrom and a forward end; and a saddle mount adapted to be attached to the forward end of said arm and having a u-shape adapted to receive a said tiller.

5 Claims, 9 Drawing Sheets

TILLER CONTROL DEVICE

FIELD OF THE INVENTION

The present invention relates to tiller control devices for small boats, especially small sailboats, and more particularly to an add-on tiller control device kit which can be installed on a sailboat so that a helmsman can engage the tiller control device with the tiller to hold the tiller in a fixed position.

BACKGROUND OF THE INVENTION

Small sailboats generally have a rudder connected to a tiller which is manually controlled by the sailor to maintain a desired course. The tiller must be minded almost continuously, particularly in foul weather or windy conditions, or the rudder will swing to head the boat into the wind which may well lead to undesirable or even disastrous consequences. Since small sailboats often have a crew of only one or two sailors, it is quite a burden to require continuous minding of the tiller. There is often a need for a helmsman to leave the tiller to adjust sails or sheets or to attend to a critical task away from the tiller but the helmsman can leave the tiller unattended only for a brief moment or in a situation which does not require maintaining control of the tiller.

Of course, a tiller control device should be easily engaged to control the tiller and also easily disengaged from controlling the tiller so that the helmsman can quickly regain control when circumstances require such action. Also, many small sailboats have limited space at the tiller and it would be desirable to have a tiller control device which could be removed and stored out of the way either along a bulkhead or elsewhere in the sailboat. Small sailboats have limited space available and it is important to use available space as efficiently as possible.

The need for a device to control the tiller to allow the helmsman to leave the tiller unattended for a limited period of time has been recognized in the prior art. Examples of patents directed to such devices include: U.S. Pat. No. 3,279,410 Oct. 18, 1966 to R. O. Young for TILLER TENDER ACCESSORY FOR SMALL BOATS; U.S. Pat. No. 3,797,441 Mar. 19, 1974 to John Burnett for TILLER CONTROLS FOR SMALL BOATS; U.S. Pat. No. 4,080,918 Mar. 28, 1978 to Robert Bruce Bonhard for RUDDER CONTROL DEVICE; U.S. Pat. No. 4,178,869 Dec. 18, 1979 to Fred C. Turrentine for COMBINED REMOVABLE TILLER EXTENSION HOLDING AND CONTROLLING DEVICE FOR WATERCRAFT; U.S. Pat. No. 4,241,684 Dec. 30, 1980 to Dan B. Davis for TILLER STEERING LOCK; and U.S. Pat. No. 4,476,800, Oct. 16, 1984 to John W. Gage for RUDDER CONTROL DEVICE.

Although as set forth above, the need for a tiller control device has been recognized in the art and there are several devices known in the art for tiller control, there remains room for improvements. For example, it would be desirable to have a rudder control kit which is readily adaptable to different sailboat designs. Such a kit would be applicable to a greater number of sailboats than a kit designed for a specific sailboat and thus could be manufactured in greater quantities at and lower cost per kit. Also, it would be desirable to have a rudder control which can be readily engaged and disengaged and which has an optional storage feature when it is not in use.

In accordance with the present invention, a tiller control kit is readily adaptable for use with the two most common tiller types and with sailboats of different sizes and designs. The tiller control kit can be economically manufactured and easily installed. Furthermore, after installation on the sailboat, the tiller control device is readily engaged and disengaged by the helmsman and can be easily removed to be readily stored out of the way.

Further understanding of the present invention will be had from the following description and claims taken in conjunction with the accompanying drawings.

SUMMARY OF THE INVENTION

In accordance with the present invention, a tiller control kit is provided, which kit can be installed on a sailboat having a tiller and a transom to provide a tiller control device of the present invention. The tiller control device can be selectively mounted on the transom of the sailboat and, when mounted, can be selectively engaged to hold the tiller of the sailboat to hold the rudder in a fixed, straight ahead, position. When engaged, the tiller control device will allow the helmsman to leave the tiller unattended for a limited period of time so long as the rudder's straight ahead position is acceptable. The tiller control device can be manufactured and provided to the consumer in the form of a kit or alternatively can be manufactured and installed by an original equipment manufacturer. The tiller control device is intended to be mounted on a sailboat and has a mounting receiver which is fixedly mounted on the transom of the sailboat and an extension arm, one end of which carries a mounting plate to interlock with the mounting receiver and the other end of which carries a U-shaped saddle to engage and hold the tiller. The mounting receiver has a slot and the mounting plate is adapted to slide into the slot to interlock with the mounting receiver. The mounting plate is selectively pivotally attached to the extension arm which is selectively extendible.

DESCRIPTION OF THE INVENTION

Broadly speaking, the present invention relates to a tiller control device which can be provided in kit form and can be installed on sailboats having a tiller and a transom. The tiller control device can be manipulated by a helmsman of the sailboat to hold the tiller and hence the rudder in a fixed, straight ahead, position. The device can be installed on sailboats having a rudder post in the transom with the tiller extending forwardly from the transom or can be installed on sailboats having a rudder post forward of the transom. Since the tiller control device can be provided in the form of a kit and is adaptable to sailboats of various sizes as well as tiller locations, the kit enjoys wide application. Hence, the kit can be manufactured in relatively large quantities to provide a tiller control for sailboats of many different sizes and designs. The tiller control device can be installed on older sailboats or installed by an original manufacturer. And while it will be appreciated by those skilled in the art that this invention is especially useful for sailboats, it may also be used with other watercraft having tillers.

Figure 1:
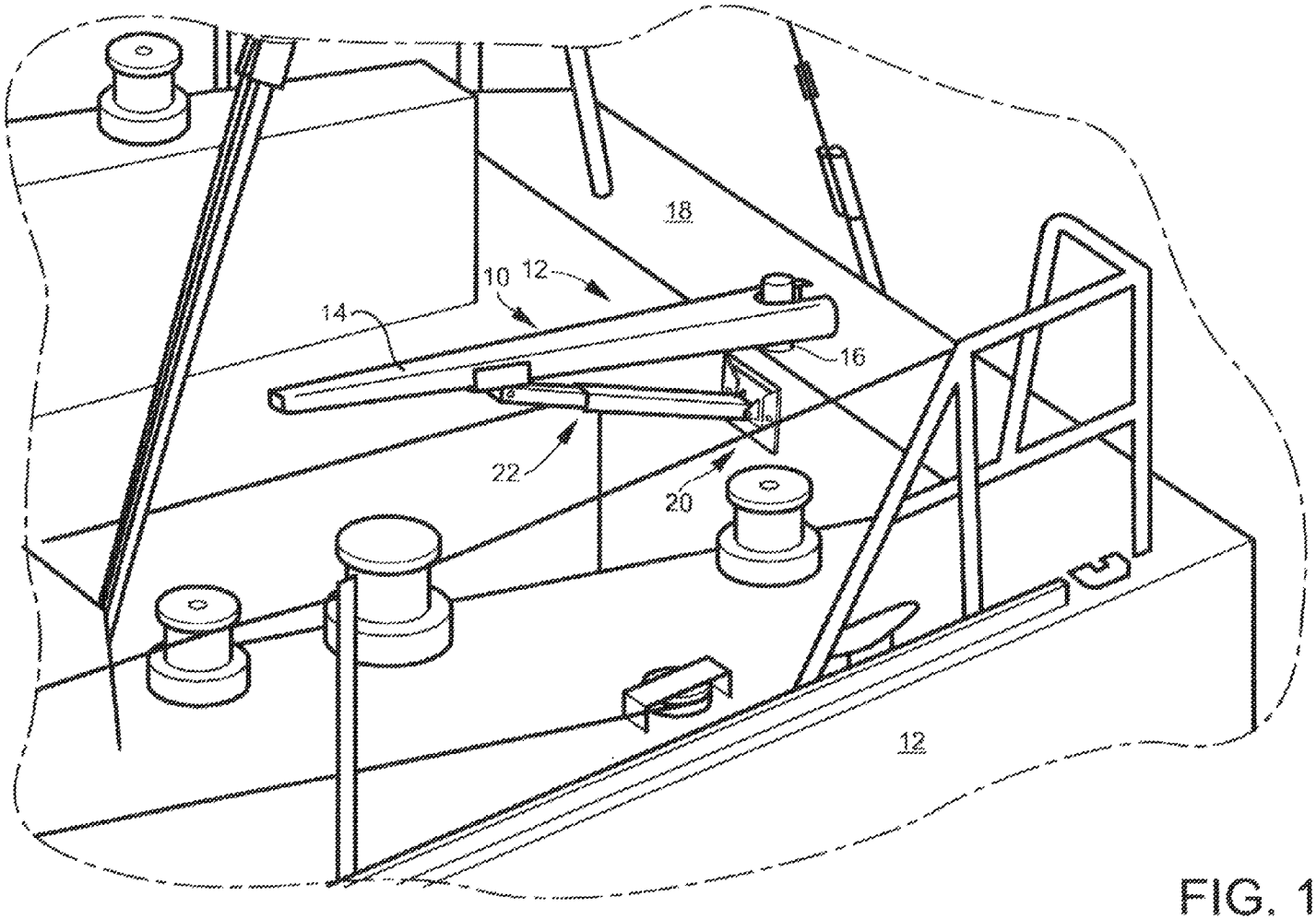
FIG. 1 is a perspective view of a preferred embodiment of a tiller control kit of the present invention shown installed on a small sail boat, broken away, the sail boat having a tiller extending horizontally forward from its transom.
Figure 2:
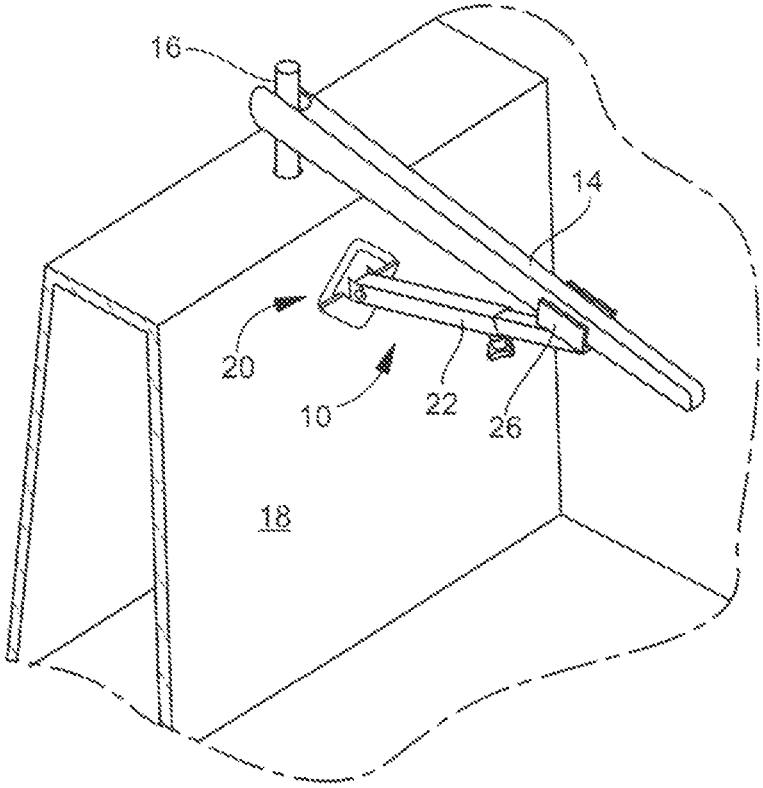
FIG. 2 is a another perspective view of the preferred embodiment of FIG. 1.
Figure 3:
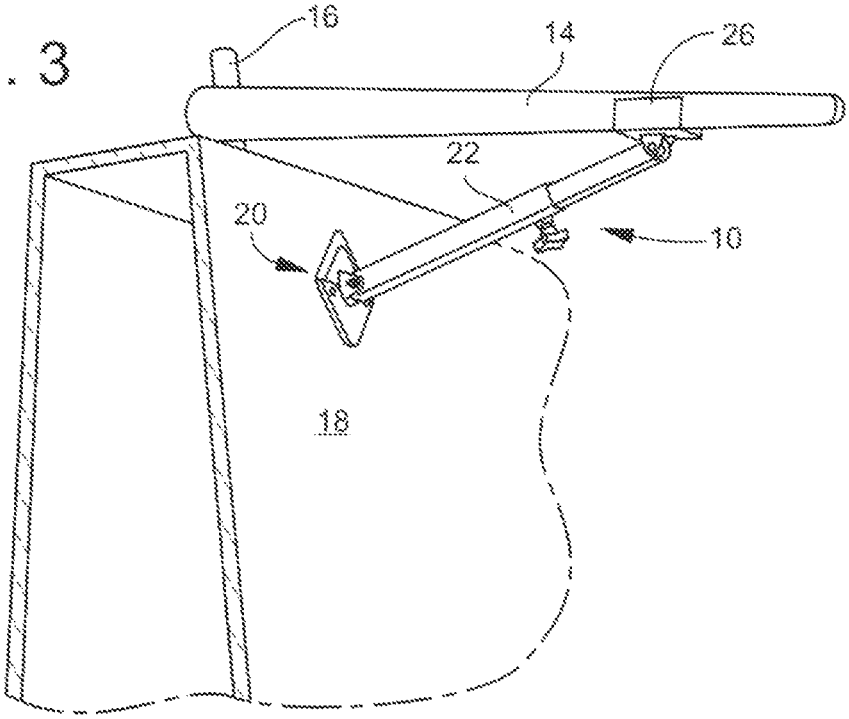
FIG. 3 is still another perspective view of the preferred embodiment of FIG. 1.
Figure 4:
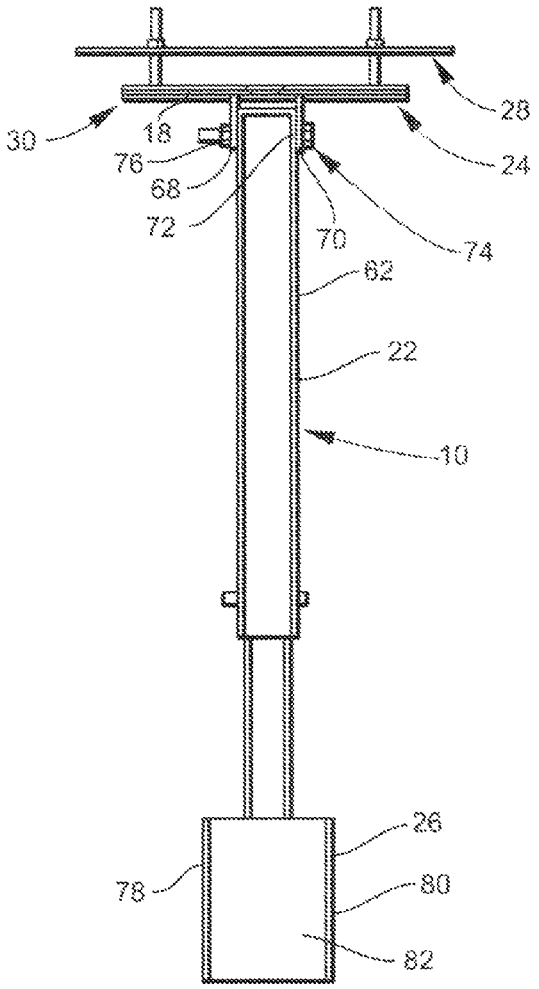
FIG. 4 is a top plan view of the preferred embodiment of FIG. 1.
Figure 5:
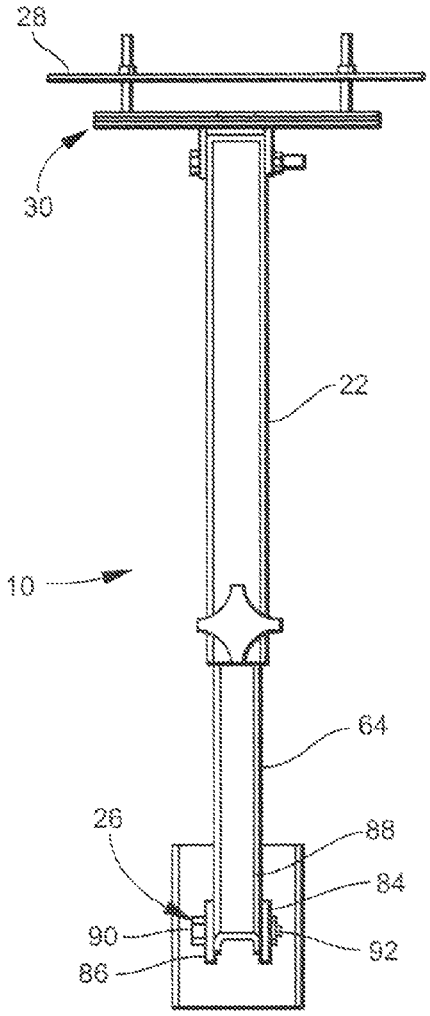
FIG. 5 is a bottom plan view of the preferred embodiment of FIG. 1.
Figure 6:
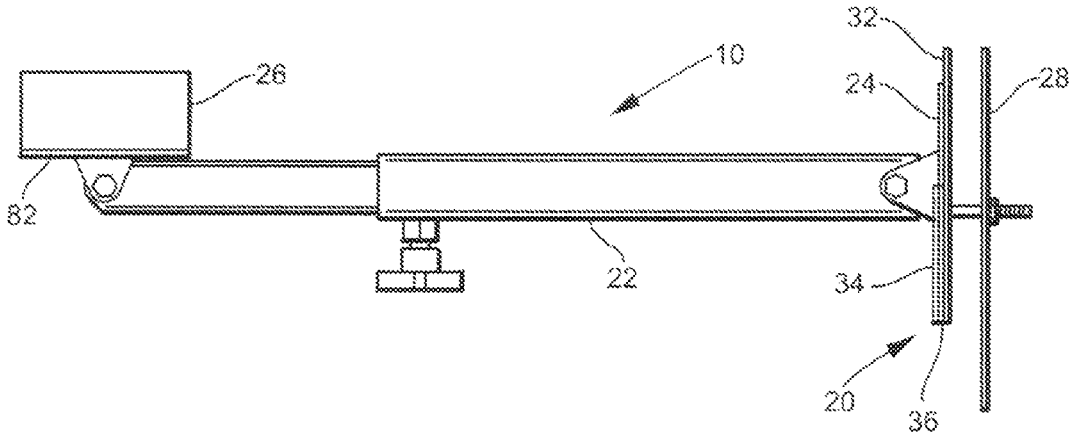
FIG. 6 is a left side elevation view of the preferred embodiment of FIG. 1.
Figure 7:
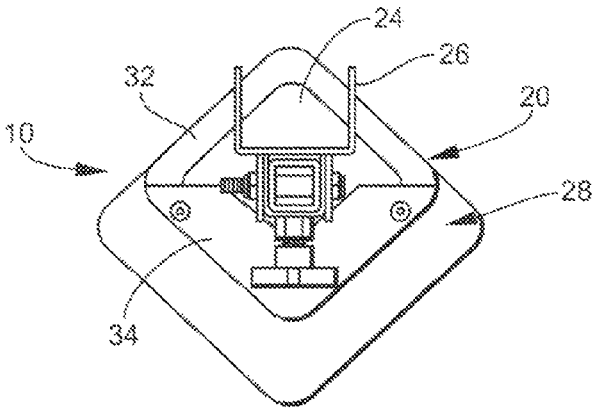
FIG. 7 is a front elevation view of the preferred embodiment of FIG. 1.
Figure 8:
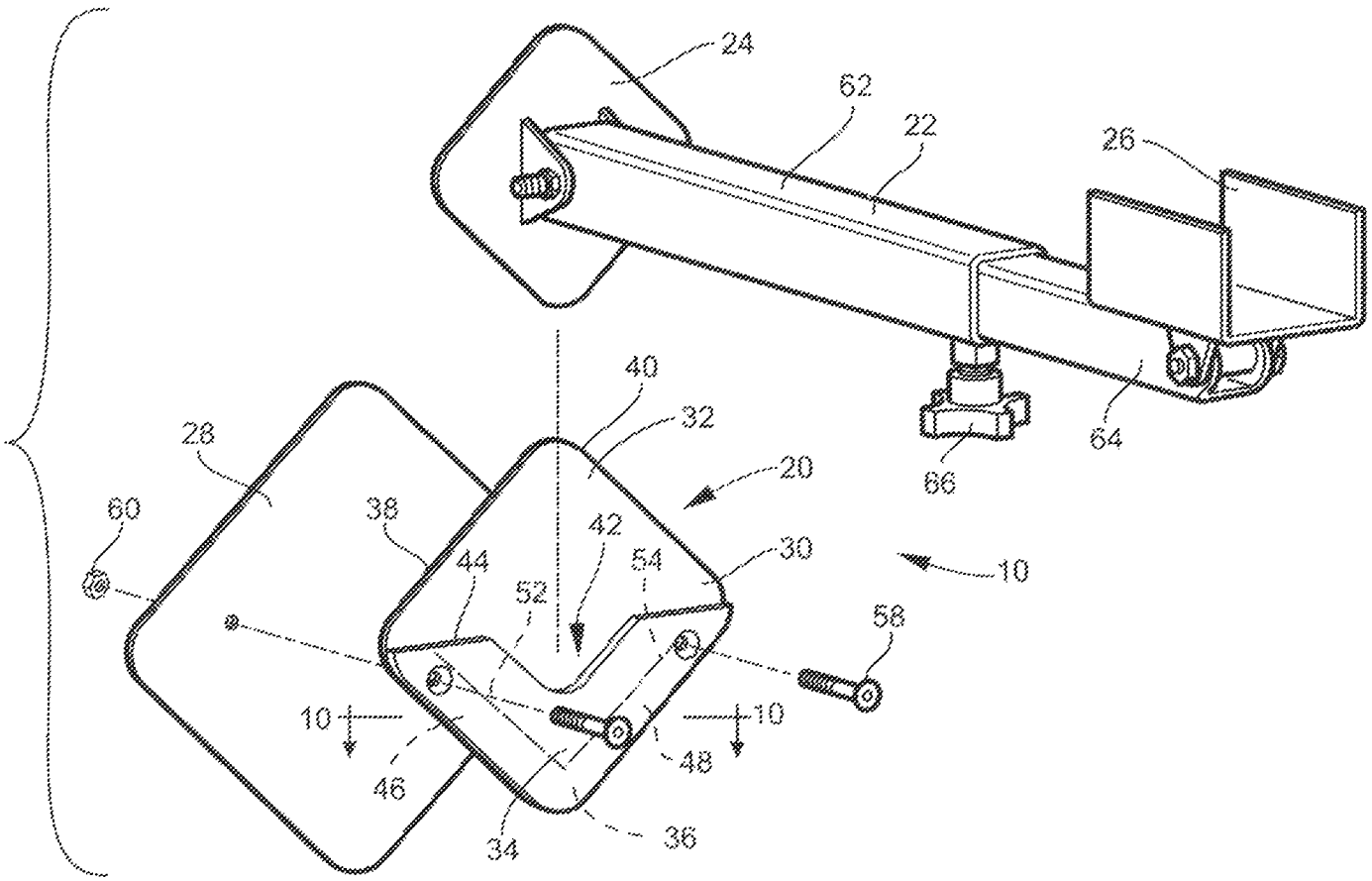
FIG. 8 is an exploded view of the preferred embodiment of FIG. 1.
Figure 9:
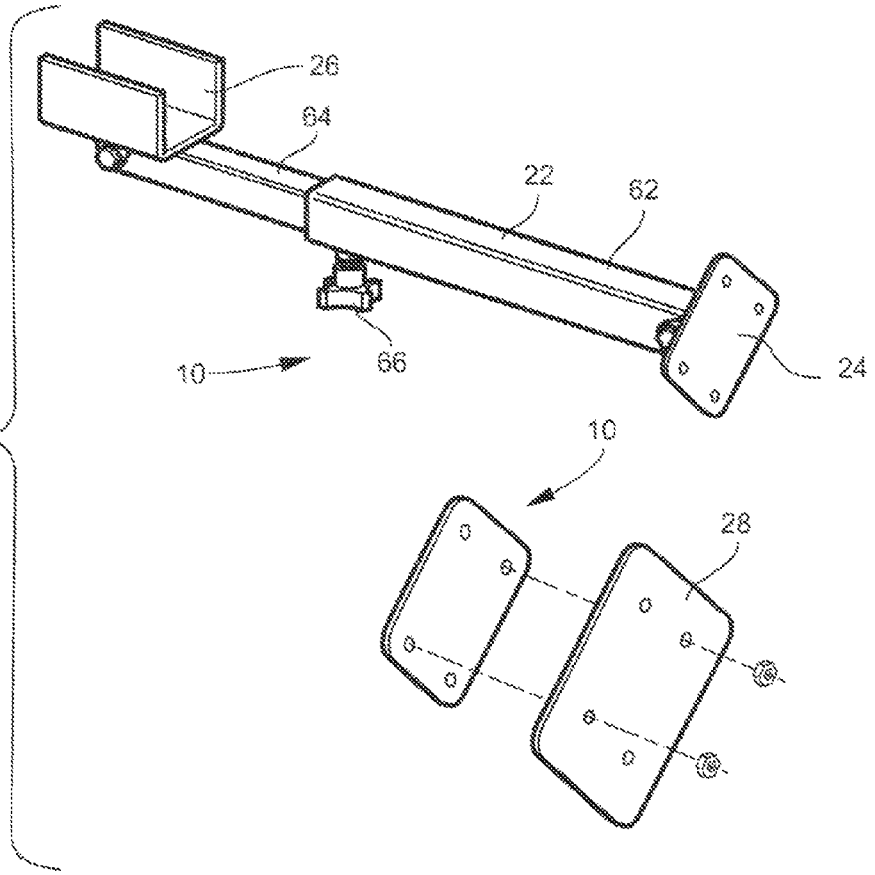
FIG. 9 is another exploded view of the preferred embodiment of FIG. 1.
Figure 10:
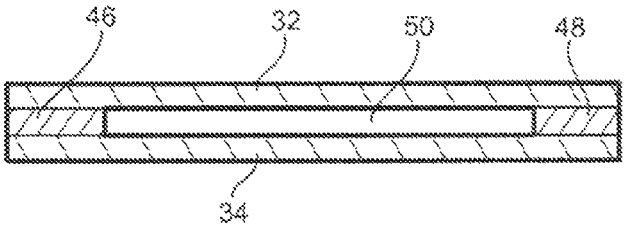
FIG. 10 is a sectional view taken along line 10-10 in FIG. 9.

Now referring to FIGS. 1-12, a preferred embodiment of a tiller control device of the present invention is indicated generally by the numeral 10. FIG. 1 shows tiller control device 10 installed on sailboat 12, broken away, having a tiller 14 pivotally connected to a rudder post 16 which extends upwardly through the top wall of transom 18. Tiller 14 is operatively connected to a rudder (not shown in the Figures) in a conventional manner. Broadly speaking, tiller control device 10 comprises mounting receiver assembly 20 and extension arm 22 which carries mounting plate 24 and tiller saddle 26.

Mounting receiver assembly 20 comprises backing plate 28 and mounting receiver 30. Mounting receiver 30 has three vertical plates, 32, 34 and 36, in sandwiched relationship. Rearward plate 32 has a generally square shape in front elevation and is oriented as shown in the figures with side edges 38 and 40 at about a 45 degree angle to the horizontal. Forward plate 34 has the general shape of an isosceles triangle in front elevation with notch 42 taken out of upwardly facing side edge 44 through which extension arm 22 extends. Sandwiched plate 36 has a generally L-shaped form in front elevation with legs 46 and 48. Of course, plates 28, 32, 34 and 36 can have any alternative geometric shape consistent with their function as described in more detail below.

Sandwiched plate 36 serves to space apart the pair of spaced apart vertical plates 32 and 34 which are in spaced apart parallel relationship with respect to each other to provide upwardly facing open slot 50 for receiving mounting plate 24 which slidingly fits between plates 32 and 34. Upwardly facing surfaces 52 and 54 of legs 46 and 48 of sandwiched plate 36 serve as stops to support mounting plate 24 when it is interlocked between vertical plates 32 and 34.

Mounting receiver assembly 20 is installed onto transom 18 by a plurality of fasteners such as nuts and bolts 60 and 62 which extend through backing plate 28 and mounting receiver 30 and which clamp backing plate 28 and mounting receiver 30 together and to transom 18. Washers, such as lock washers not shown in the figures, may also used. Of course, the type and number of fasteners may vary so long as they function satisfactorily to hold mounting receiver assembly 20 together and onto transom 18. For example, where transom 18 is comprised of wood, screws may be used instead of nuts and bolts.

Extension arm 22 carries mounting plate 24 and tiller saddle 26. Extension arm 22 has an elongated tubular structure, preferably square or rectangular in cross-section, although any alternative cross-sectional shapes may be used if functional the intended function of extension arm 22 which is to have selectively variable length and to carry mounting plate 24 at one end and tiller saddle 26 at its other end. To provide adjustable length to extension arm 22, it is comprised of first and second telescopic arms 62 and 64 which are slidably disposed in telescopic relationship. Extension arm lock 66 has a knob with a shaft threadably disposed in a bore through one wall of telescopic arm 62 so that the internally disposed end of the shaft comes into contacting relationship with telescopic arm 64 when the knob is rotated in a direction to move the shaft inwardly to thereby lock telescopic arms 62 and 64. Thus, extension arm lock 66 can be manipulated to lock or unlock the length of extension arm 22 to thereby provide an extension arm 22 which is selectively adjustable in length.

Mounting plate 24 is generally square in front elevation with an orientation corresponding to vertical plate 32 of mounting receiver 30. Brackets 68 and 70 are welded or otherwise attached to mounting plate 24 and extend forwardly towards and in overlapping relationship to end 72 of telescoping arm 62. Brackets 68 and 70 are pivotally attached to first end 72 of first telescopic arm 62 of extension arm 22 by bolt 74 which extends through axially aligned bores in telescopic arm 62 and brackets 68 and 70. Nut 76 secures bolt 74 and can be tightened to lock the angle of extension arm 22 with respect to mounting plate 24 as described further below.

Tiller saddle 26 has a generally U-shaped body with sides 78 and 80 and web 82. Welded or otherwise attached to web 82 are brackets 84 and 86. Tiller saddle 26 is pivotally attached to second end 88 of telescopic arm 64 of extension arm 22 by bolt 90 which extends through aligned bores in end 88 and brackets 84 and 86. Nut 92 secures bolt 90 and can be tightened to selectively lock the angle of tiller saddle 26 with respect to extension arm 22.

Figure 11:
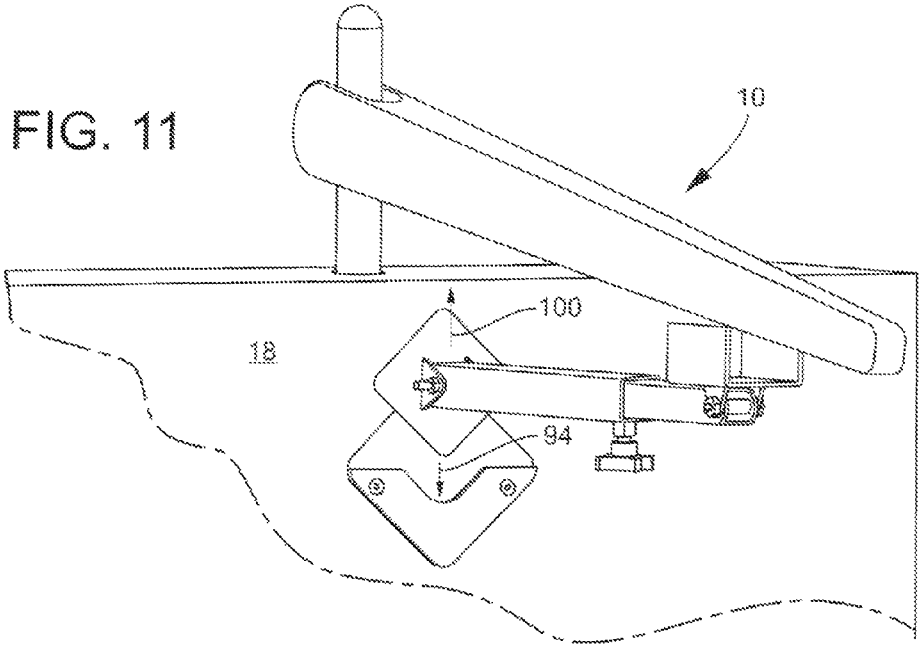
FIG. 11 is a perspective view illustrating mounting the mounting plate of the preferred embodiment of FIG. 1 into the mounting receiver of the preferred embodiment of FIG. 1.
Figure 12:
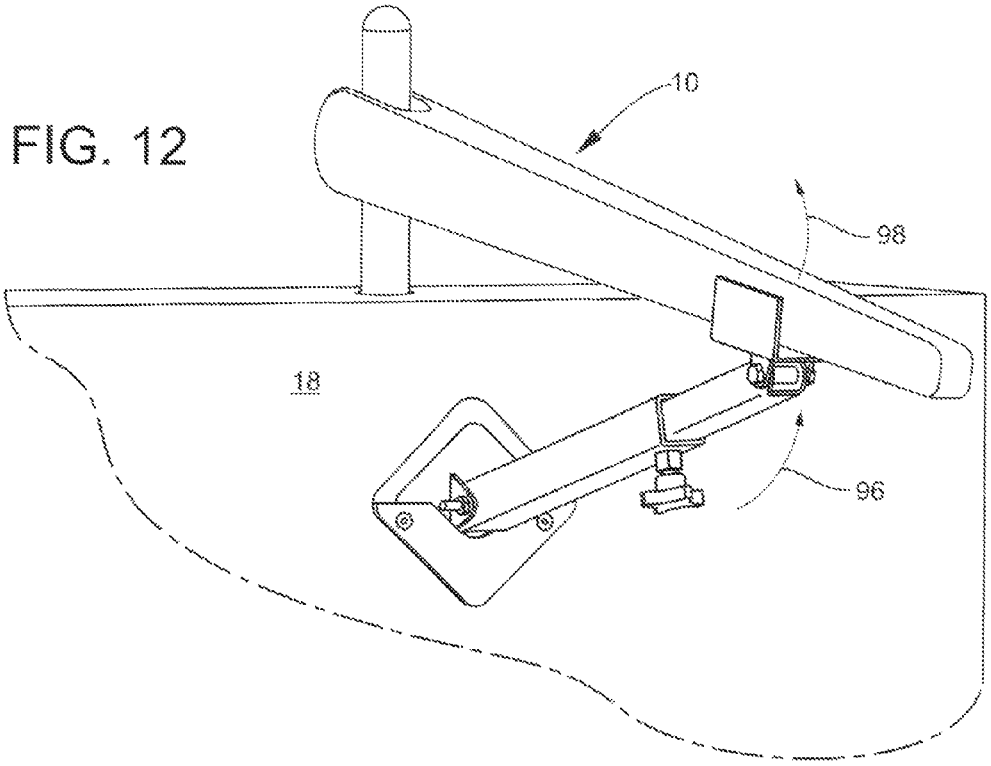
FIG. 12 is a perspective view illustrating engagement of the tiller with the tiller control of the preferred embodiment of FIG. 1.

In operation, it is intended that installation of tiller control device 10 a sailboat will be carried out by first mounting mounting receiver assembly 20 on the transom of the sailboat. This mounting is intended to be permanent. Then, and as best illustrated in FIG. 11, extension arm 22 is removably installed by placing reversible mounting plate 24 in slot 50 in mounting receiver assembly 20 as indicated by arrow 94. Either before or after this step, the length of extension arm 22 is adjusted to an appropriate length and extension arm lock 66 is tightened to fix the length of extension arm 22. When it is desired to hold the tiller in position, extension arm 22 is moved upwardly as illustrated by arrow 96 until tiller saddle 26 receives the tiller whereupon nuts 76 and 92 are tightened to hold extension arm 22 in operative configuration to lock the tiller in straight ahead, central position. When manipulation of the tiller by the helmsman is desired, the helmsman lifts up the forward end of the tiller as indicated by arrow 98 in FIG. 12 to thereby disengage it from tiller saddle 26 and when it is desired to store extension arm 22 out of the way, one simply removes mounting plate 24 from slot 50 in mounting receiver 30 by lifting mounting plate 24 upwardly as indicated by arrow 100 in FIG. 11 to thereby free extension arm 22 for storage elsewhere. Optionally, storage against transom 18 can be had by rotating mounting plate 24 so that bolt 74 is vertical, pivoting mounting plate 24 so that its plane extends substantially parallel to the longitudinal axis of extension arm 22 and then inserting mounting plate 24 into slot 50 in mounting receiver assembly 20.

Figure 13:
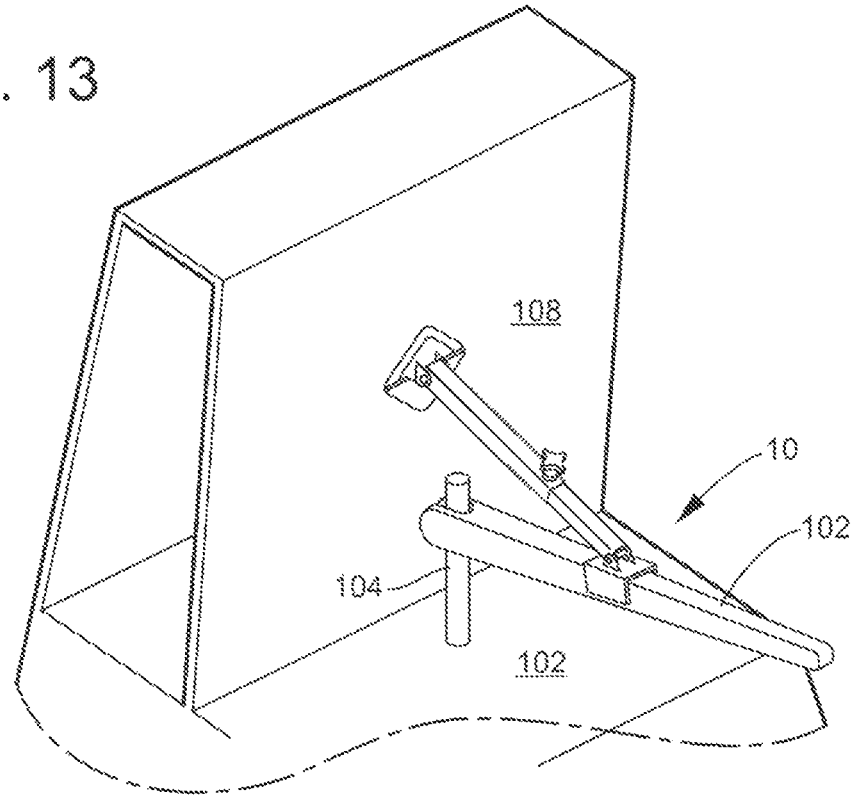
FIGS. 13 and 14 are perspective views of the preferred embodiment of a tiller control of FIG. 1 installed on a sailboat, broken away, the sailboat having a tiller post extending vertically through the cockpit deck forward of the transom.
Figure 14:
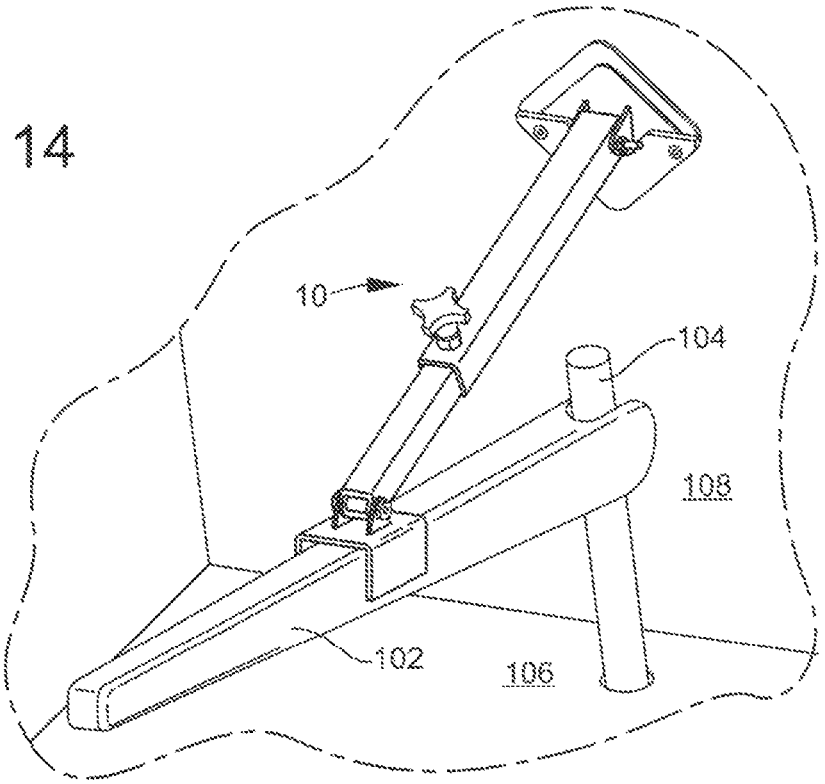

Now referring to FIGS. 13 and 14, a preferred embodiment of a kit of the present invention is shown and indicated by the numeral 10 but is shown in use with a tiller having a tiller 102 connected to a rudder post 104 which extends upwardly through deck 106 forward of transom 108. Tiller control device 10 of FIGS. 13 and 14 comprises the same parts as set forth above but is positioned above rather than below tiller 102.

In operation of the configuration shown in FIGS. 13 and 14, tiller 102 supports the forward end of extension arm 22 since tiller 102 is conventionally limited in downward movement to the position shown in the figures. Nut 76 secures bolt 74 but need not be tightened to prevent pivotal movement of extension arm 22. Thus, when it is desired to disengage tiller control device 10 from tiller 102, the helmsman can easily pivot extension arm 22 upwardly so that tiller 102 is clear of tiller saddle 26 and tiller 102 is free.

Figure 15:
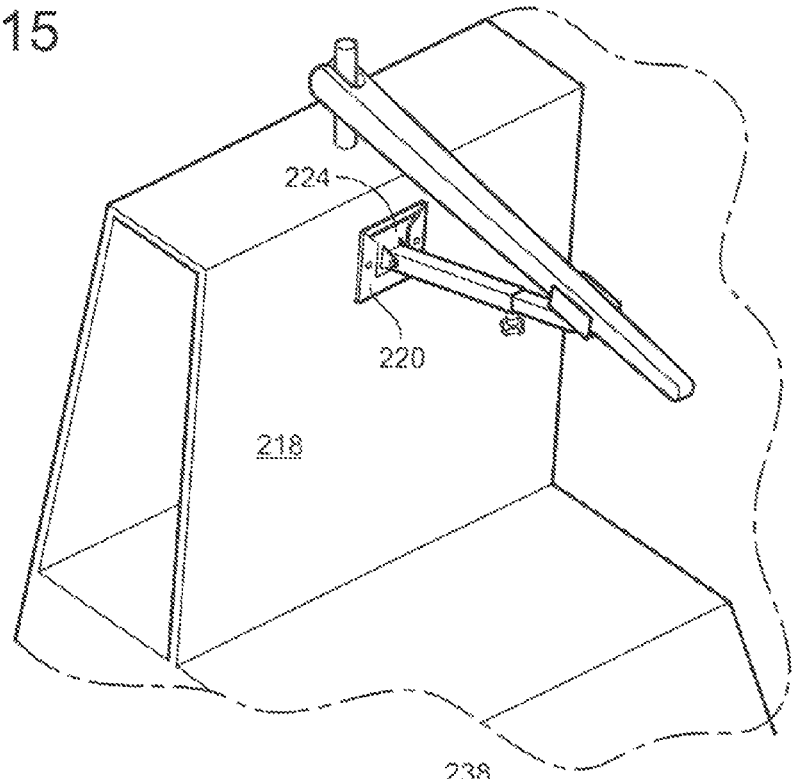
FIGS. 15 and 16 are perspective views showing an alternative mounting plate and mounting receiver of a preferred embodiment of a tiller control of the present invention.
Figure 16:
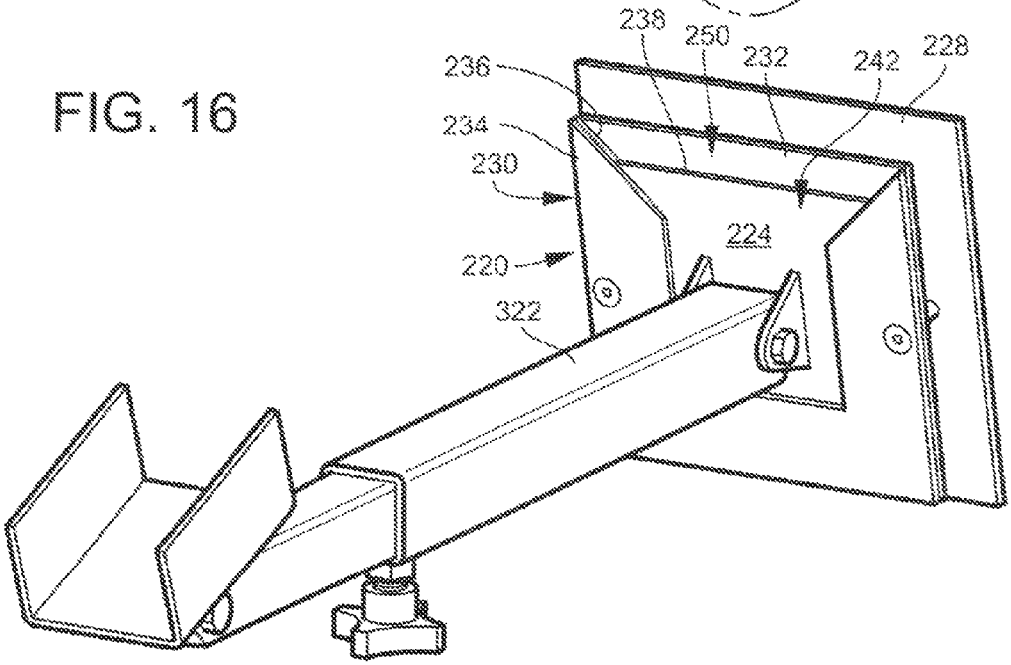

Now referring to FIGS. 15 and 16, an alternative mounting receiver assembly and mounting plate are shown and indicated generally by the numerals 220 and 224 respectively. Mounting receiver assembly 220 comprises backing plate 228 and mounting receiver 230. Mounting receiver 230 has three vertical plates, 232, 234 and 236, in sandwiched relationship. Plate 232 has a generally square shape in front elevation and is oriented as shown in the figures with side edge 238 which is horizontally disposed. Plate 234 has a generally U-shape in front elevation to provide notch 242 to accommodate extension arm 322. Sandwiched plate 236 has a generally U-shaped form in front elevation and serves to space apart vertical plates 232 and 234 to provide slot 250 for receiving mounting plate 224. Sandwiched plate 236 has an upwardly facing surface in the web of its U-shape which acts as a stop to support mounting plate 224 when it is interlocked between vertical plates 232 and 234.

Mounting receiver assembly 220 is installed onto transom 218 by a plurality of fasteners which extend through backing plate 228 and mounting receiver 230 and which clamp backing plate 228 and mounting receiver 230 together and to transom 218.

It will be appreciated by those skilled in the art that a tiller control kit of the present invention should be made of marine quality materials such as stainless steel, aluminum, or engineered plastics. Also, it will be appreciated by those skilled in the art that the present invention is subject to modification and variation. It is intended that such modifications and variations are considered to be within the broad scope of the invention which is intended to be limited only by the following claims.

What is claimed is:

1. A tiller control device for a boat having a tiller and a transom, said tiller control device comprising:

a mounting receiver assembly attached to said transom, said mounting receiver assembly having an upwardly facing open slot; and an extension arm having a first end and a second end, a mounting plate selectively pivotally attached to said first end, said mounting plate received in the slot of the mounting receiver assembly in interlocking relationship with said mounting receiver assembly, said extension arm having a U-shaped saddle attached to said second end, said tiller held in said U-shaped saddle mount.

2. The tiller control device of claim 1, wherein said mounting receiver assembly has a rearward plate and a forward plate mounted in spaced apart parallel relationship, said forward plate having a notch therein through which said extension arm extends.

3. The tiller control device of claim 1, including a mounting receiver assembly having a pair of spaced apart vertical plates, said mounting plate adapted to slidingly fit in said slot between said vertical plates of said mounting receiver.

4. The tiller control device of claim 1, wherein said extension arm has a first telescopic arm and a second telescopic arm member in adjustable telescopic relationship.

5. A tiller control kit for controlling the position of a tiller on a sailboat having a transom, said tiller control kit comprising:

a mounting receiver assembly for attachment to said transom, said mounting receiver having a rearward plate and a forward plate in spaced apart parallel relationship, said forward plate having a notch therein;

an extension arm having a first end and a second end;

a mounting plate attached to said first end of said extension arm, said mounting plate sized to slidingly fit between said rearward plate and said forward plate of said mounting receiver; and a saddle attached to said second end of said extension arm and having a u-shape sized to receive said tiller.

* * * * *